United States Patent [19]

Elsbett et al.

[11] Patent Number: 4,715,335

[45] Date of Patent: Dec. 29, 1987

[54] INTERNAL COMBUSTION ENGINE WITH REDUCED NOISE AND HEAT EMISSIONS

[76] Inventors: Ludwig Elsbett; Günter Elsbett; Klaus Elsbett, all of Industriestrasse 14, D-8543 Hilpoltstein, Fed. Rep. of Germany

[21] Appl. No.: 710,864

[22] Filed: Mar. 12, 1985

[30] Foreign Application Priority Data

Mar. 13, 1984 [DE] Fed. Rep. of Germany ..... 3409101

[51] Int. Cl.[4] ..... F01P 3/10; F01P 3/20

[52] U.S. Cl. ..... 123/41.35; 123/41.42; 123/198 E

[58] Field of Search ..... 123/41.42, 41.35, 198 E, 123/514

[56] References Cited

U.S. PATENT DOCUMENTS

| | | | |
|---|---|---|---|
| 1,420,684 | 6/1922 | Bradshaw | 123/41.42 |
| 2,085,810 | 7/1937 | Ljungstrom | 123/41.42 |
| 3,731,660 | 5/1978 | Leffert | 123/41.42 |
| 4,230,087 | 10/1980 | Abe et al. | 123/198 E |
| 4,508,065 | 4/1985 | Suchdex | 123/41.35 |
| 4,519,358 | 5/1985 | Redele | 123/514 |

FOREIGN PATENT DOCUMENTS

| | | | |
|---|---|---|---|
| 2140824 | 2/1973 | Fed. Rep. of Germany | 123/41.42 |
| 3314543 | 10/1984 | Fed. Rep. of Germany | 123/41.42 |
| 1134746 | 1/1985 | U.S.S.R. | 123/41.42 |

*Primary Examiner*—William A. Cuchlinski, Jr.
*Attorney, Agent, or Firm*—Peter K. Kontler

[57] ABSTRACT

There is disclosed an internal combustion engine with reduced emission of sound, heat and harmful substances. The characteristics of an air-cooled engine are optimized as a result of withdrawal of heat by oil in uniform distribution along the entire peripheries of the cylinders. For this purpose, there was developed a lower piston portion which effects uniform distribution of cooling oil along the periphery. The external cooling is improved in that the entire periphery of each free-standing cylinder is provided with a recessed ring-shaped oil guide and in that the free-standing cylinders are located in a common chamber which is cooled by oil sprays. More pronounced uniformity of such cooling action along the entire periphery of each cylinder allows for the selection of a higher temperature level of the cylinders which is important for combustion of vegetable oils in lieu of mineral oil products. At the same time, the above construction strives to accomplish the object of improving the power density and running characteristics of a diesel engine.

18 Claims, 2 Drawing Figures

INTERNAL COMBUSTION ENGINE WITH REDUCED NOISE AND HEAT EMISSIONS

BACKGROUND OF THE INVENTION

The invention relates to an oil cooled reciprocating internal combustion engines with free standing cylinders and low emission of heat, sound and harmful substances.

The equation cooling equals heating must apply for all combustion engines. However, what is expected from a future engine is that the emission of heat should be as low as possible. In addition, unavoidable heat losses should be utilized, at a maximum possible heat level, for useful purposes, such as e.g., cabin heating. Since cooling water boils at a relatively low temperature and cooling air cannot be used for numerous purposes as a result of its contamination by the engine, it is desirable to utilize engine oil as a cooling medium. For this reason, there were numerous attempts to provide engine parts, such as pistons, cylinders and cylinder heads, with oil chambers in order to intercept the developing heat (e.g., German Pat. No. 26 49 562).

For reasons which are attributable to the thermal characteristics of oil, the equation heating equals cooling applies only in the case of low heating action, i.e., small engine output.

Substantially higher engine outputs with pure oil cooling are achieved when the piston and the combustion process are selected in such a way that only little heat can pass from the combustion chamber to the cylinder wall (German Pat. No. 33 14 543). However, here again there exists a limit as to the capacity of such oil cooling in that the cooling action is effective substantially only transversely of the crankshaft. Such cooling is not effective in the direction of longitudinal section of the engine because the deflecting vanes for cooling oil which are disposed in the lower portion of the piston act in a single direction. Thus, the internal cooling is not uniformly distributed along the periphery. The external cooling, too, is not effective along the entire periphery of the cylinder because each of the cylinders constitutes a one-piece casting. Such construction exhibits internal as well as external cooling defects, as considered in the longitudinal direction of the crankshaft.

OBJECTS AND SUMMARY OF THE INVENTION

In order to optimize the oil cooled engine in this respect, too, it is proposed in accordance with the invention to improve the internal oil cooling of cylinders and pistons in that, in the lower portion of the piston, the return flow of upwardly sprayed cooling oil is deflected through an angle of 90° which brings about a substantial improvement in the thermal roundness of the cylinder.

External cooling of each cylinder is improved in that the cylinders are free standing and are installed in the oil sprayed chamber of the engine. This is accomplished in that the cylinders are disposed in V-formation and are covered by a common cover for both rows of cylinders. This cover replaces the customary cylinder head covers so that all of the oil which serves for valve regulation and head cooling can be further utilized for external cooling of the cylinders.

Furthermore, and in contrast to German Pat. No. 33 14 543, the annular space for external oil cooling which is provided in the upper end of the cylinder is led all the way around the cylinder. The increased cylinder spacing which is required for such purpose is obtained in that the crank drive has a separate wobble for each cylinder rather than, as is customary in V-engines, servicing two cylinders from a common crankpin.

As concerns the reduction of heating and the cooling, the present application relies on the pistons (such as a steel link piston) and combustion process as disclosed in patent DE No. 33 14 543. However, in order to further reduce the emission of heat, the cylinders and one-half of each cylinder head are kept out of the path of outwardly directed heat radiation in that the engine walls and the engine cover are of twin-walled construction with an insulating layer between the twin walls.

That which in the present case serves to reduce the emission of heat further entails a reduction of the emission of sound which is becoming more and more important for the diesel engine.

The reduction of harmful substances, e.g., CH, is accomplished in the contemplated circumferential cooling of the cylinder in that the piston can be of much more gasproof design. It can be placed tightly against the cylinder already at a level above the piston rings. In this respect, all of the conventional cooling methods were deficient because the pistons could not conform to the lack of thermal roundness of the cylinder. This allows for the development of harmful substances in the sealing gaps.

For the procentually largest emission, namely the expulsion of $CO_2$, it will be important in the future that the maximum thermal density of the combustion process and of the parts of the combustion chamber be coupled with an optimum gasproofing of pistons and cylinders. Only this renders it possible to utilize as engine fuel vegetable oils in lieu of mineral oil products.

BRIEF DISCRIPTION OF THE DRAWING

FIG. 1 is a transverse sectional view of a V-type engine which embodies the invention; and FIG. 2 is an enlarged axial sectional view of the lower portion of a piston in the engine of FIG. 1.

DESCRIPTION OF THE PREFERRED EMBODIMENTS

Figure 1:
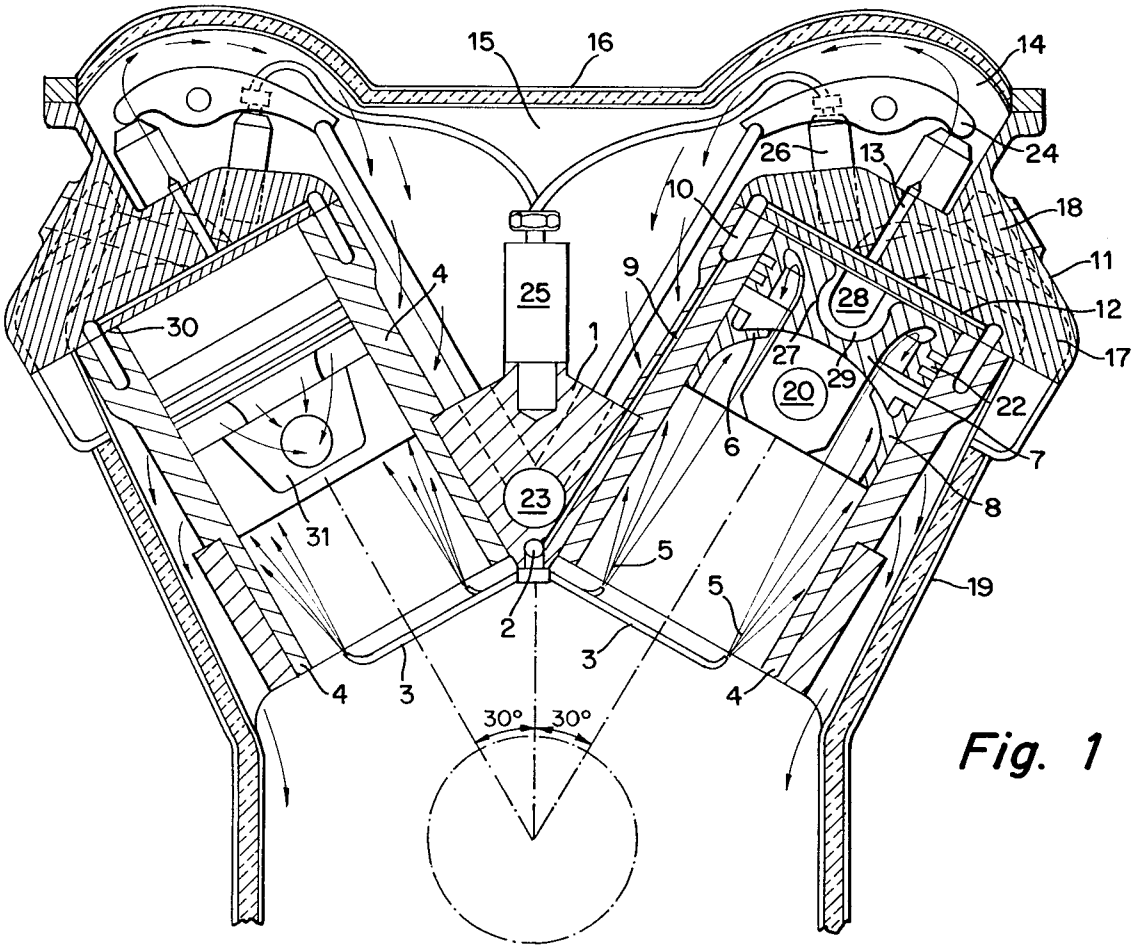

FIG. 1 shows the internal and external oil spraying of cylinders 4. The engine housing has an oil supplying channel 2 which receives lubricating oil, for conveying to one or more oil sprayers 3 which spray oil onto the interior of the cylinder 4 in each plane of movement of the respective connecting rod. The oil spray 5 is directed by guide vanes 6 in the direction toward the upper portion 7 of the respective piston to be thereupon conveyed to the lower portion 8 of the piston. Cooling oil flows through a second bore 9 into an annular space 10 which extends into the cylinder head 11. From the annular space 10, cooling oil flows through a bore 12, 13 into a valve control chamber 14 wherefrom it is deflected into a common oil chamber 15 to cool the cylinders 4 from the outside by oil sprays. This common oil chamber 15 for the two rows of cylinders is overlapped by a common cover 16 which closes the two valve control chambers 14. Only that part of each cylinder head 11 which is located outside of the respective valve control chamber 14 is not sprayed with oil. Such part of each cylinder head 11 is traversed by channels for the inlet 17 and outlet 18. Return flow of external cooling oil takes place between the free standing cylinders 4 and is limited by the sound- and heat-insulating outer wall 19.

The cylinders 4 are entirely free standing so that each annular channel 10 extends all around the respective cylinder. An oil cooling along the entire periphery of the cylinder is also achieved at the inner side of the cylinder. For this purpose, the inner side of the lower portion 8 of each piston is provided with guide vanes 6 which extend in the direction of the piston bolt 20 and the outer side of each piston is provided with guide surfaces 31 (FIG. 2) which extend transversely of the piston bolt. In this manner, cooling oil reaches the entire periphery of the cylinder and approximately 80% of the cylinder length of the internal cylinder surface.

Inner cooling oil does not reach that cylinder surface which is covered by a piston sealing jacket 22; therefore, oil sprays 5 cool the inner surface of the sealing jacket. The depth of the annular channel 10 approximates the length of the sealing jacket which guarantees an especially satisfactory oil cooling of this important upper part of the cylinder, too.

The noise generating parts, such as the camshaft 23, valve drive 24, injection pump 25 and nozzle 26, are also installed in the common sound- and heat-sealed oil chamber 15. The higher operating temperature for the injection elements is intentional because it is required if the fuel is vegetable oil.

In the piston combustion chamber 27, there takes place a combustion process wherein surplus air 29 circulates around the hot combustion zone 28 which ensures satisfactory protection against elevated temperatures in the upper portion 7 of the piston.

Such mode of minimal heating and cooling renders it possible to dispense with the customary gas seal between the cylinder and cylinder head at the connecting location 30.

Figure 2:
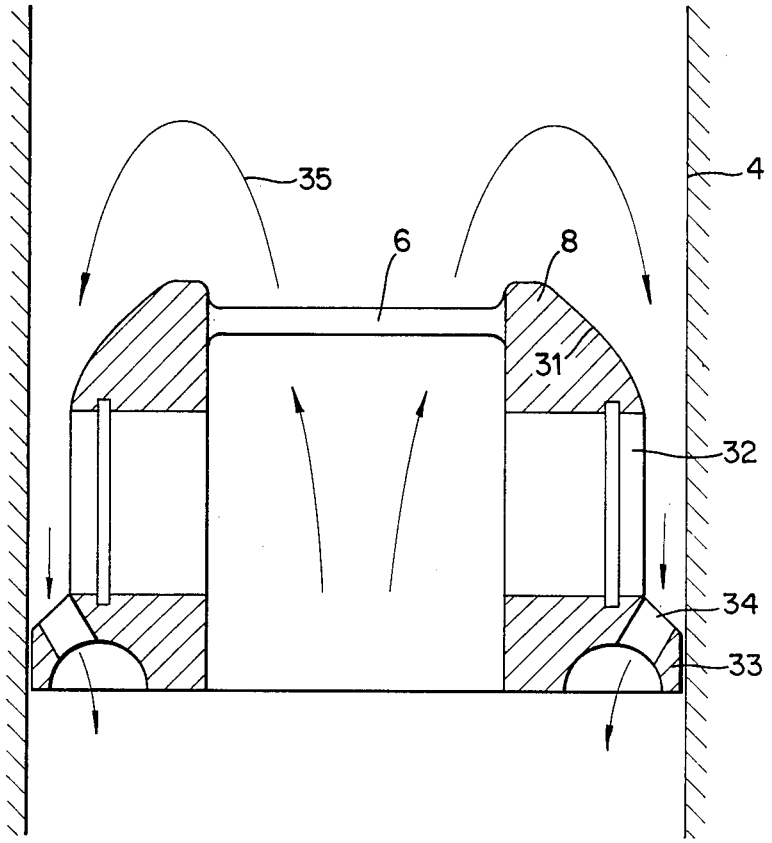

FIG. 2 shows a section of the lower portion 8 of the piston as seen in the direction of the piston bolt and with the outer guide surfaces 31 which intercept oil sprays 5 propelled back by the upper portion 7 (FIG. 1) of the piston and deflect oil into the bore for the piston bolt 32. There, oil is held for a short interval of time by the lower oil sealing edge 33 in order to achieve a more intensive cooling of the cylinder wall in such plane. Oil thereupon flows through ports or bores 34 into the lower portion of the cylinder 4. The arrows 35 denote oil which is sprayed upwardly by the guide surfaces 6 and is deflected back by the upper portion of the piston.

I claim:

1. An oil cooled reciprocating internal combustion engine, comprising a crankshaft; a plurality of free standing cylinders extending upwardly from said crankshaft and each having an internal surface and an external surface; means for at least substantially uniformly cooling said internal and external surfaces at least substantially exclusively by oil, including means for supplying oil to said cylinders and means for directing such oil against the major portions at least of the internal and external surfaces of said cylinders; and means defining a common chamber for said cylinders which contributes to uniformity of distribution of temperatures along the peripheries of the cylinders.

2. The engine of claim 1, wherein said spraying means includes means for directing oil sprays against approximately 80% of the internal surface of each of said cylinders.

3. The engine of claim 1, wherein said cylinders are in V-formation in two rows at an angle of approximately 60°.

4. The engine of claim 1, wherein said chamber defining means includes a heat- and soundproof jacket.

5. The engine of claim 1, further comprising reciprocable pistons provided in said cylinders and each including a first portion and a spaced-apart second portion, said oil directing means including guide vanes provided in the first portions of said pistons and arranged to direct oil between the respective first and second portions, and guide surfaces provided on said first portions to thereupon direct such oil transversely against the internal surfaces of the respective cylinders.

6. The engine of claim 5, wherein the first portion of each of said pistons has a bore and further comprising a piston bolt in each of said bores, said bores being arranged to collect oil which is directed by said guide surfaces against the internal surfaces of the respective cylinders.

7. The engine of claim 6, wherein the first portion of each of said pistons has a sealing edge in engagement with the internal surface of the respective cylinder and arranged to collect oil in the region of the respective bore.

8. The engine of claim 6, wherein the first portion of each of said pistons has at least one port adjacent to the corresponding piston bolt and arranged to allow for evacuation of oil from the region of the corresponding bore by gravity flow.

9. The engine of claim 1, wherein said chamber defining means includes a heat- and soundproof jacket, said directing means including bores provided in said cylinders for conveying oil from the interior of said cylinders into said chamber.

10. The engine of claim 1, further comprising a reciprocable piston in each of said cylinders pistons, said crankshaft having a discrete crank pin for each of said pistons so as to allow for adequate spacing apart of said free standing cylinders from each other.

11. The engine of claim 1, further comprising heatproof steel link pistons in said cylinders.

12. The engine of claim 1, further comprising means for recovering heat from oil which is used to cool said cylinders.

13. The engine of claim 12, further comprising means for utilizing recovered heat for preheating of the fuel which is supplied to the engine.

14. The engine of claim 1, further comprising pistons in said cylinders, said oil directing means being arranged to reduce the clearances between the pistons and the respective cylinders as a result of external and internal cooling of the cylinders.

15. The engine of claim 1, further comprising pistons received with clearance in said cylinders, said oil directing means being arranged to cool said cylinders by quantitative regulation of oil which is directed against the internal and external surfaces of said cylinders so that the clearances between said cylinders and the respective pistons remain substantially unchanged in all load ranges when the engine is in use.

16. The engine of claim 1 for combustion of diesel fuel in accordance with the single-jet combustion process, further comprising pistons reciprocably received with clearance in said cylinders and said chamber defining means including a sound- and heatproof jacket, said cooling means being arranged to minimize the clearances between said pistons and the respective cylinders.

17. An oil cooled reciprocating internal combustion engine, comprising a crankcase; a plurality of free standing cylinders extending upwardly from said crankcase and each having an internal surface and an external surface, said cylinders including heads; valve controls mounted on said heads; and means for at least substantially uniformly cooling said internal and external surfaces including means for supplying oil to said cylinders and means for directing such oil against the major portions at least of the internal and external surfaces of said cylinders, said oil directing means comprising a cover common to all of said cylinders and said valve controls and arranged to direct oil sprays against the external surfaces of said cylinders.

18. In an internal combustion engine, a cylinder having an internal surface; a rotary crankshaft; a piston reciprocable in said cylinder and having a first portion nearer to and a second portion more distant from said crankshaft, said first portion having a substantially axially extending passage and first guide means in said passage; means for directing oil sprays against said guide means by way of said passage, said guide means being oriented to direct the sprays against said second portion so that the sprays are repelled by said second portion back against said first portion, said first portion further having second guide means disposed in the path of repelled sprays and oriented to direct the repelled sprays against the internal surface of said cylinder; and means for reciprocating said piston in response to rotation of said crankshaft.

* * * * *